US007608999B2

(12) United States Patent
Kim

(10) Patent No.: US 7,608,999 B2
(45) Date of Patent: Oct. 27, 2009

(54) PDP HAVING A FIRING ELECTRODE

(75) Inventor: Woo Tae Kim, Yongin-si (KR)

(73) Assignee: LG Electronics Inc., Seoul (KR)

( * ) Notice: Subject to any disclaimer, the term of this patent is extended or adjusted under 35 U.S.C. 154(b) by 409 days.

(21) Appl. No.: 11/246,121

(22) Filed: Oct. 11, 2005

(65) Prior Publication Data

US 2006/0076891 A1 Apr. 13, 2006

(30) Foreign Application Priority Data

Oct. 11, 2004 (KR) ..... 10-2004-0081130

(51) Int. Cl.
*H01J 17/49* (2006.01)

(52) U.S. Cl. ..... 313/583; 313/584; 313/585

(58) Field of Classification Search ..... 313/583–585
See application file for complete search history.

(56) References Cited

U.S. PATENT DOCUMENTS 4,032,215 A 6/1977 Jarmofsky et al.
6,522,072 B1 * 2/2003 Yura et al. ..... 313/582
6,819,046 B2 * 11/2004 Hirano ..... 313/582
6,879,104 B2 * 4/2005 Tessier ..... 313/582
7,081,706 B2 * 7/2006 Huang et al. ..... 313/583
2001/0024921 A1 * 9/2001 Hirano ..... 445/24
2002/0063524 A1 * 5/2002 Nakamura et al. ..... 313/582
2002/0084752 A1 * 7/2002 Yoshioka et al. ..... 313/584
2004/0032215 A1 * 2/2004 Nishimura et al. ..... 315/169.3
2007/0035246 A1 * 2/2007 An ..... 313/583
2007/0046210 A1 * 3/2007 An ..... 313/583
2007/0278957 A1 * 12/2007 Hsu ..... 313/584

FOREIGN PATENT DOCUMENTS

KR 10-2003-0024887 4/2003

* cited by examiner

*Primary Examiner*—Peter Macchiarolo
(74) *Attorney, Agent, or Firm*—McKenna Long & Aldridge LLP

(57) ABSTRACT

The present invention relates to a plasma display panel comprising a bus electrode. A plasma display panel according to the present invention comprises a first bus electrode and a second bus electrode forming a discharge gap; a barrier rib forming a discharge cell; a first firing electrode connected with the first bus electrode to protrude in the direction of the center of the discharge cell; and a second firing electrode connected with the second bus electrode to protrude in the direction of the center of the discharge cell. The present invention can lower the manufacturing cost of plasma display panel and lower a firing voltage, improving a discharge efficiency as discharges are performed by bus electrodes and firing electrodes without transparent electrodes.

8 Claims, 4 Drawing Sheets

PDP HAVING A FIRING ELECTRODE

This Nonprovisional application claims priority under 35 U.S.C. §119(a) on Patent Application No. 2004-0081130 filed in Korea on Oct. 11, 2004 the entire contents of which are hereby incorporated by reference.

BACKGROUND OF THE INVENTION

1. Field of the Invention

The present invention relates to a plasma display panel, more particulary to a plasma display panel comprising a bus electrode.

2. Description of the Background Art

Generally, in a plasma display panel, barrier ribs formed between a front substrate and a rear substrate form unit or discharge cells. Each of the cells is filled with an inert gas, such as a mixture of He and Xe, or a mixture of He and Ne. When the inert gas is discharged by a high frequency voltage, the inert gas generates vacuum ultraviolet rays, which thereby cause a fluorescent substance to emit light, thus displaying an image.

FIG. 1 is a perspective view illustrating the configuration of a conventional plasma display panel. As shown in FIG. 1, the plasma display panel comprises a front glass substrate 10 displaying an image and a rear glass substrate 20. The front glass substrate 10 and the rear glass substrate 20 are disposed parallel to each other with a predetermined space.

A scan electrode 11 and a sustain electrode 12 are formed on the front glass substrate 10 to maintain the light emission of each cell. Each of the scan electrode 11 and the sustain electrode 12 comprises a transparent electode 11*a*, 12*a* made of a transparent ITO material and a bus electrode 11*b* and 12*b* made of a metal material.

A scanning signal for panel scanning and a sustain signal for discharge sustaining are applied through the scan electrode 11. The sustain signal is applied through the sustain electrode 12.

A dielectric layer 13*a* that covers the scan electrode 11 and the sustain electrode 12 for limits the discharge current and provides insulation between electrode pairs. A protection layer 14 is formed for emitting secondary electrons.

A barrier rib 21 is formed on the rear glass substrate 20 to form a discharge cell. An address electrode 22 is formed on the rear glass substrate 20 and disposed parallel with the barrier rib 21. A dielectric layer 13*b* is formed on the upper side of the address electrode 22. R, G and B flouorescent layer 23 emits a visible ray, is coated on the upper side of the dielectric layer 13*b*.

The front glass substrate 10 and the rear glass substrate 20 are coupled through frit glass. A ventilation process is performed to eliminate impurities inside of the panel. An inert gas such as He, Ne, Xe is injected into inside of panel to improve discharge efficiency.

The transparent electode 11*a*, 12*a* forming the scan electrode 11 and the sustain electrode 12 of conventional plasma display panel are made of an expensive ITO material. As a result, the transparent elecrode 11*a* and 12*a* increases the manufacturing cost of a plasma display panel manufacturing.

SUMMARY OF THE INVENTION

Accordingly, an object of the present invention is to solve at least the problems and disadvantages of the background art.

The object of the present invention is to provide a plasma display panel comprising a bus electrode.

A plasma display panel according to the present invention comprises a first bus electrode and a second bus electrode forming a discharge gap; a barrier rib forming a discharge cell; a first firing electrode connected to the first bus electrode to protrude in the direction of the center of the discharge cell; and a second firing electrode connected to the second bus electrode to protrude in the direction of the center of the discharge cell.

A plasma display panel according to the present invention comprises a plurality of first bus electrodes; a plurality of second bus electrodes formed on the opposite side of the plurality of first bus electrodes; a barrier rib forming a discharge cell; a first firing electrode connected to the first bus electrode adjacent to the center of the discharge cell among the plurality of the first bus electrodes to protrude in the direction of the center of the discharge cell; and a second firing electrode connected to the second bus electrode adjacent to the center of the discharge cell among the plurality of the second bus electrodes to protrude in the direction of the center of the discharge cell.

A plasma display panel according to the present invention comprises a plurality of first bus electrodes; a plurality of second bus electrodes formed on the opposite side of the plurality of first bus electrodes; a barrier rib forming a discharge cell; a first firing electrode connected to the first bus electrode adjacent to the center of the discharge cell among the plurality of the first bus electrodes to protrude in the direction of the center of the discharge cell; a second firing electrode connected to the second bus electrode adjacent to the center of the discharge cell among the plurality of the second bus electrodes to protrude in the direction of the center of the discharge cell; a first connection electrode connecting the plurality of the first bus electrodes in the discharge cell area; and a second connection electrode connecting the plurality of the second bus electrodes in the discharge cell area.

The present invention decreases the manufacturing cost of plasma display panel because discharges are performed by bus electrodes and firing electrodes rather than by transparent electrodes.

The present invention decreases a firing voltage and improve a discharge efficiency by using bus electrodes and firing electrodes.

BRIEF DESCRIPTION OF THE DRAWINGS

The invention will be described in detail with reference to the following drawings in which like numerals refer to like elements.

DETAILED DESCRIPTION OF PREFERED EMBODIMENTS

Figure 1:
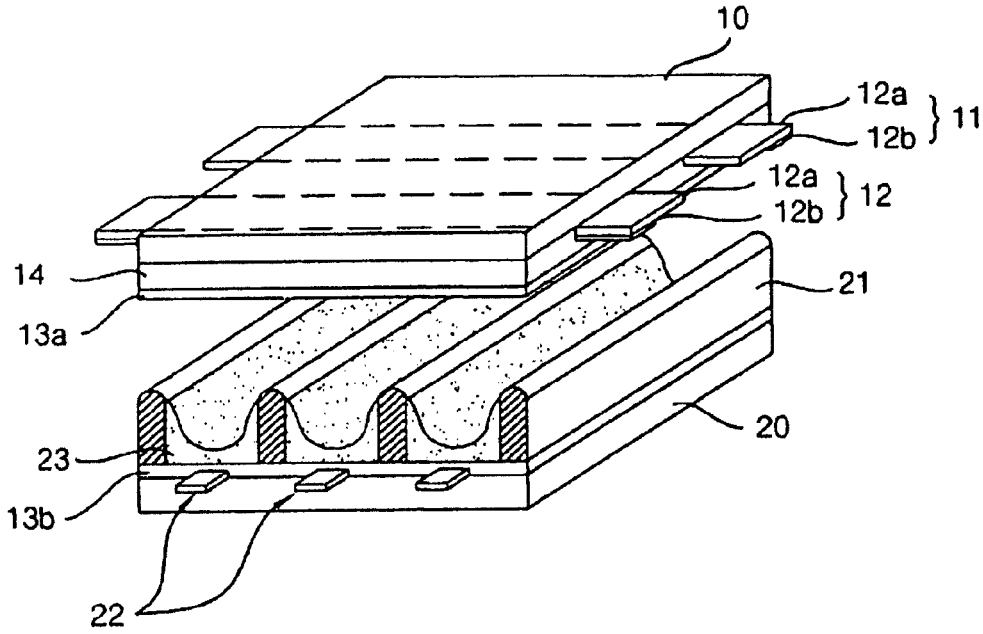
Fig. 1 Related Art
FIG. 1 is a perspective view illustrating the configuration of a conventional plasma display panel.

Preferred embodiments of the present invention will be described in a more detailed manner with reference to the drawings.

A plasma display panel according to the present invention comprises a first bus electrode and a second bus electrode forming a discharge gap; a barrier rib forming a discharge cell; a first firing electrode connected to the first bus electrode to protrude in the direction of the center of the discharge cell; and a second firing electrode connected to the second bus electrode to protrude in the direction of the center of the discharge cell.

The first firing electrode is formed on the barrier rib.

The second firing electrode is formed on the barrier rib.

The first firing electrode comprises a first protrusion electrode perpendicularly connected to the first firing electrode.

The second firing electrode comprises a second protrusion electrode perpendicularly connected to the second firing electrode.

A plasma display panel according to the present invention comprises a plurality of first bus electrodes; a plurality of second bus electrodes formed on the opposite side of the plurality of first bus electrodes; a barrier rib forming a discharge cell; a first firing electrode connected to the first bus electrode adjacent to the center of the discharge cell among the plurality of the first bus electrodes to protrude in the direction of the center of the discharge cell; and a second firing electrode connected to the second bus electrode adjacent to the center of the discharge cell among the plurality of the second bus electrodes to protrude in the direction of the center of the discharge cell.

The first firing electrode is formed on the barrier rib.

The second firing electrode is formed on the barrier rib.

The first firing electrode comprises a first protrusion electrode perpendicularly connected to the first firing electrode.

The second firing electrode comprises a second protrusion electrode perpendicularly connected to the second firing electrode.

The ends of the plurality of the first bus electrodes are connected to each other.

The ends of the plurality of the second bus electrodes are connected to each other.

The first bus electrode adjacent to the center of the discharge cell among the plurality of the first bus electrodes is separated from the second bus electrode adjacent to the center of the discharge cell among the plurality of the second bus electrodes at a distance of 120 μm to 300 μm.

A plasma display panel according to the present invention comprises a plurality of first bus electrodes; a plurality of second bus electrodes formed on the opposite side of the plurality of first bus electrodes; a barrier rib forming a discharge cell; a first firing electrode connected to the first bus electrode adjacent to the center of the discharge cell among the plurality of the first bus electrodes to protrude in the direction of the center of the discharge cell; a second firing electrode connected to the second bus electrode adjacent to the center of the discharge cell among the plurality of the second bus electrodes to protrude in the direction of the center of the discharge cell; a first connection electrode connecting the plurality of the first bus electrodes in the discharge cell area; and a second connection electrode connecting the plurality of the second bus electrodes in the discharge cell area.

The first firing electrode is formed on the barrier rib.

The second firing electrode is formed on the barrier rib.

The first firing electrode comprises a first protrusion electrode perpendicularly connected to the first firing electrode.

The second firing electrode comprises a second protrusion electrode perpendicularly connected to the second firing electrode.

The first bus electrode adjacent to the center of the discharge cell among the plurality of the first bus electrodes is separated from the second bus electrode adjacent to the center of the discharge cell among the plurality of the second bus electrodes at a distance of 120 μm to 300 μm.

Hereinafter, the embodiments of the invention will be described with reference to the following drawings.

A First Embodiment

Figure 2:
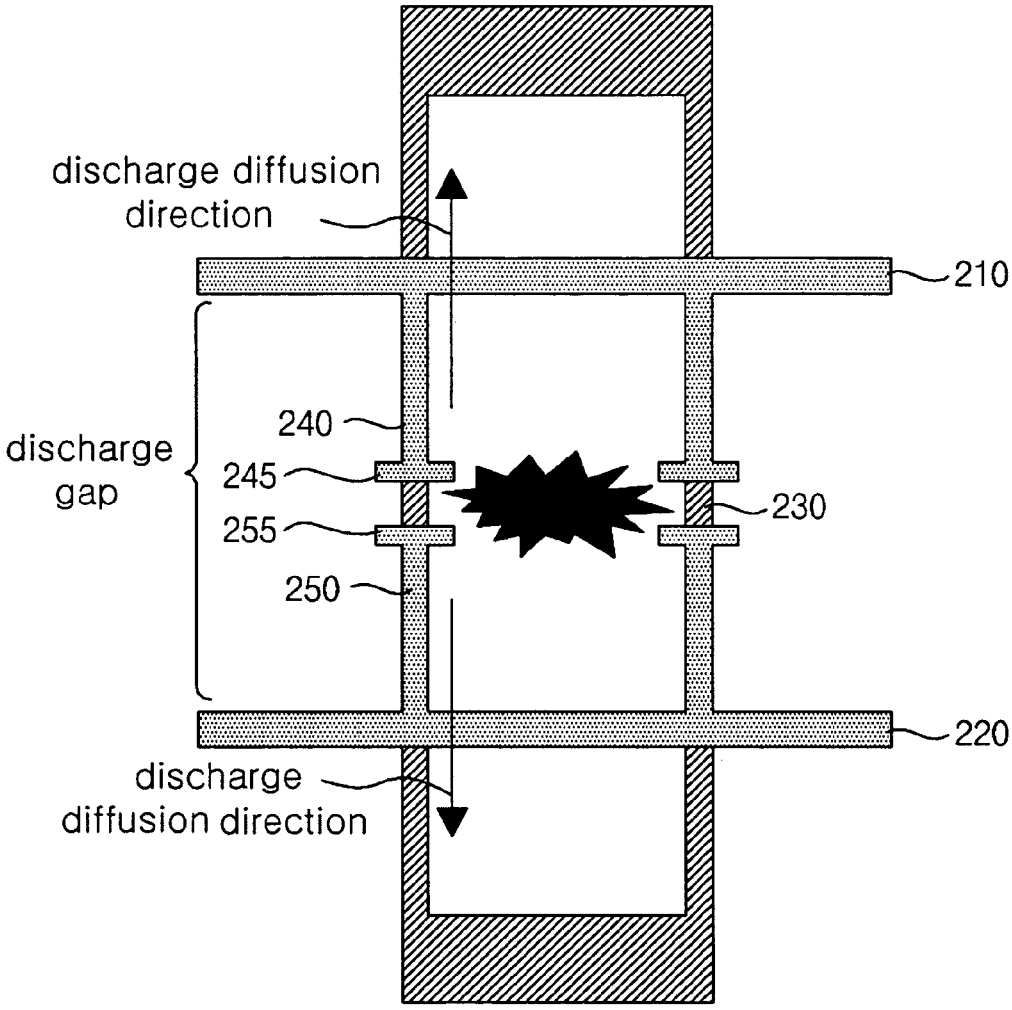
FIG. 2 is a plan view illustrating a plasma display panel according to a first embodiment of the present invention.

FIG. 2 is a plan view illustrating a plasma display panel according to a first embodiment of the present invention. As shown in FIG. 2, a plasma display panel according to the first embodiment of the present invention comprises a first bus electrode 210, a second bus electrode 220, a barrier rib 230, a first firing electrode 240 and a second firing electrode 250.

The first bus electrode 210 and the second bus electrode 220 form a discharge gap 260. The first bus electrode 210 performs the fuction of scan electrode and the second bus electrode 220 performs the sustain electrode fuction.

The barrier rib 230 forms a discharge cell.

The first firing electrode 240 is connected to the first bus electrode 210 to protrude in the direction of the center of the discharge cell. The first firing electrode 240 may be formed within a discharge cell. However, preferably, the first firing electrode 240 should be formed on the barrier rib to prevent a decrease in the light transmitting rate. The first firing electrode 240 comprise a first protrusion electrode 245 disposed in the perpendicular direction of the first firing electrode 240.

The second firing electrode 250 is connected to the second bus electrode 220 to protrude in the direction of the center of the discharge cell. The second firing electrode 250 may be formed within a discharge cell. However, preferably, the second firing electrode 250 should be formed on the barrier rib to prevent a decrease in the light transmitting rate. The second firing electrode 250 comprise a second protrusion electrode 255 disposed in the perpendicular direction of the first firing electrode 250.

The first embodiment of the present invention comprises the first bus electrode 210, the second bus electrode 220, the first firing electrode 240 and the second firing electrode 250. Accordingly, the first embodiment of the present invention decreases the manufacturing cost of a plasma display panel.

When discharges are performed only with the first bus electrode 210 and the second bus electrode 220, a discharge gap increases to be greater than the conventional discharge gap formed by transparent electrodes so that the discharge efficiency increases. However, as a result, the firing voltage will increase to much. When the distance between electrodes increases, the capacitance between electrodes decreases. When the capacitance decreases, the reactive power decreases so that the discharge efficiency increases. In this case, however, the firing voltage increases as it is difficult to perform discharges when the distance between electrodes increases. When discharges are performed with the first firing electrode 240 and the second firing electrode 250, together with the first bus electrode 210 and the second bus electrode 220, the gap between the first firing electrode 240 and the second firing electrode 250 is small so that discharges are initiated by small firing voltage. When discharges are initiated by the first firing electrode 240 and the second firing electrode 250, discharges are diffused to the whole dischrge cell by the first bus electrode 210 and the second bus electrode 220. Accordingly, the first firing electrode 240 and the second firing electrode 250 play a role to lower the firing voltage. The first bus electrode 210 and the second bus electrode 220 improve the discharge efficiency.

When the first firing electrode 240 and the second firing electrode 250 are formed on the barrier rib, the decrease in the light transmitting rate is minimized and the firing voltage decreases. The first protrusion electrode 245 and the second protrusion electrode 255 support the first firing electrode 240 and the second firing electrode 250 to perform discharges in a satisfactory manner.

A Second Embodiment

Figure 3:
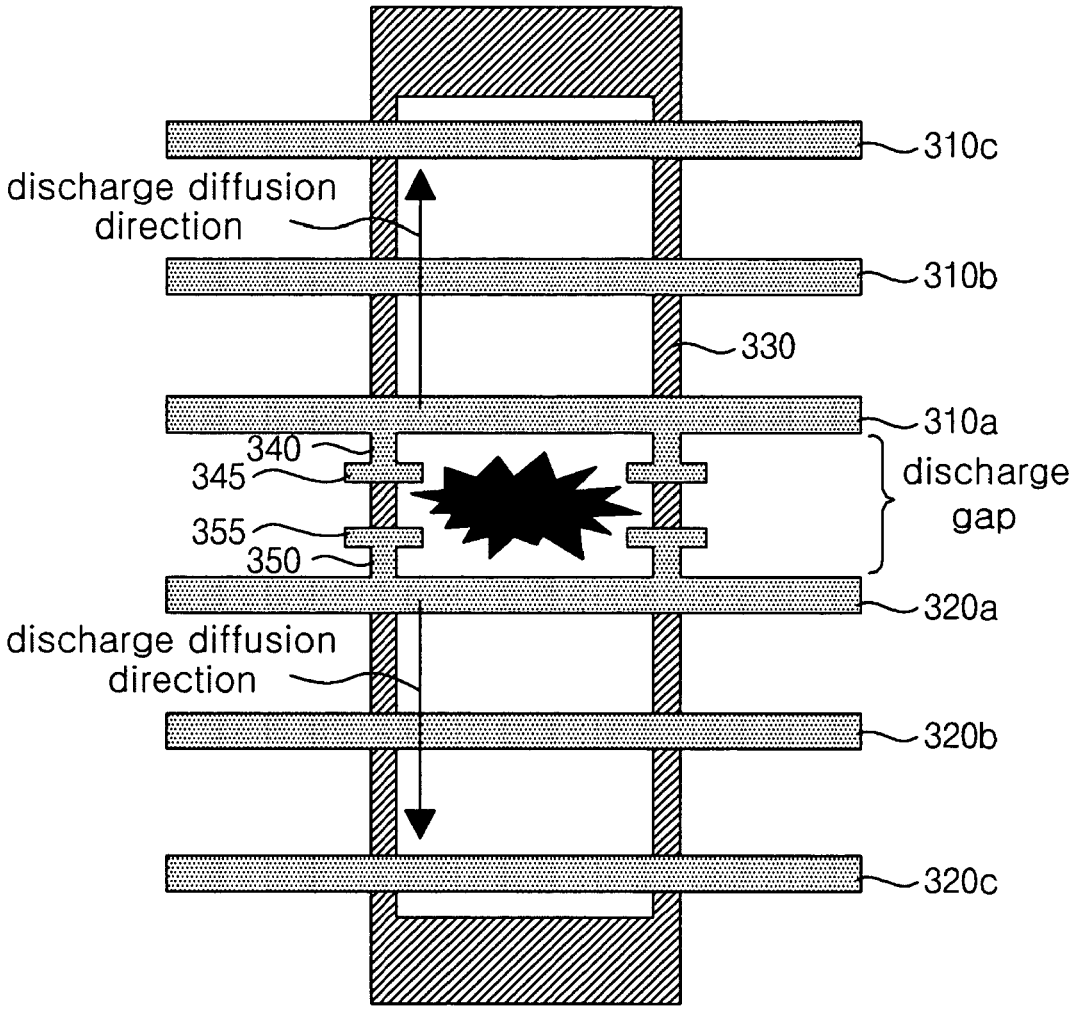
FIG. 3 is a plan view illustrating a plasma display panel according to a second embodiment of the present invention.

FIG. 3 is a plan view illustrating a plasma display panel according to a second embodiment of the present invention. As shown in FIG. 3, a plasma display panel according to the second embodiment of the present invention comprises a first bus electrode 310*a*, 310*b* and 310*c*, a second bus electrode 320*a*, 320*b* and 320*c*, a barrier rib 330, a first firing electrode 340 and a second firing electrode 350.

A plurality of the first bus electrodes 310*a*, 310*b* and 310*c* are disposed in parallel with each other. The ends of the plurality of the first bus electrodes 310*a*, 310*b* and 310*c* are connected to each other. Thus, the plurality of the first bus electrodes 310*a*, 310*b* and 310*c* are not electrically separated, but are electrically connected to perform the scan electrode function.

A plurality of the second bus electrodes 320*a*, 320*b* and 320*c* are disposed in parallel with each other. The first bus electrode 310*a* adjacent to the center of discharge cell among the plurality of the first bus electrodes 310*a*, 310*b* and 310*c* and the second bus electrode 320*a* adjacent to the center of discharge cell among the plurality of the second bus electrodes 320*a*, 320*b* and 320*c* form a discharge gap. The ends of the plurality of the second bus electrodes 320*a*, 320*b* and 320*c* are connected to each other. Thus, the plurality of the second bus electrodes 320*a*, 320*b* and 320*c* are not electrically separated, but are electrically connected to perform the sustain electrode function.

The barrier rib 330 forms a discharge cell.

The first firing electrode 340 is connected to the first bus electrode 310*a* adjacent to the center of discharge cell among the plurality of the first bus electrodes 310*a*, 310*b* and 310*c* to protrude in the direction of the center of the discharge cell. The first firing electrode 340 may be formed within a discharge cell. However, preferably, the first firing electrode 340 should be formed on the barrier rib to prevent a decrease in the light transmitting rate. The first firing electrode 340 comprise a first protrusion electrode 345 disposed in the perpendicular direction of the first firing electrode 340.

The second firing electrode 350 is connected to the second bus electrode 320*a* adjacent to the center of discharge cell among the plurality of the second bus electrodes 320*a*, 320*b* and 320*c* to protrude in the direction of the center of the discharge cell. The second firing electrode 350 may be formed within a discharge cell. However, preferably, the second firing electrode 350 should be formed on the barrier rib to prevent the decrease in the light transmitting rate. The second firing electrode 350 comprises a second protrusion electrode 355 disposed in the perpendicular direction of the first firing electrode 350.

The second embodiment of the present invention comprises the plurality of the first bus electrodes 310*a*, 310*b* and 310*c*, the plurality of the second bus electrodes 320*a*, 320*b* and 320*c*, the first firing electrode 340 and the second firing electrode 350. Accordingly, the second embodiment of the present invention decreases the manufacturing cost of a plasma display panel. Different than the first embodiment of the present invention, the second embodiment of the present invention comprises a plurality of first bus electrodes and a plurality of second bus electrodes. Thus, the diffusion of discharges is easier than the first embodiment.

Different with the second embodiment of the present invention, if discharges are performed with only the first bus electrode 310*a*, 310*b* and 310*c* and the second bus electrode 320*a*, 320*b* and 320*c*, a discharge gap increases to be greater than the conventional gap so that the discharge efficiency increases. However, as a result, the firing voltage will increase to much. In other words, if the distance between electrodes increases, the capacitance between electrodes decreases. When the capacitance decreases, the reactive power decreases so that the discharge efficiency increases. However, when the distance between electrodes increases, the firing voltage increases as it is difficult to perform discharges. Thus, when discharges are performed with the first firing electrode 340 and the second firing electrode 350, together with the plurality of the first bus electrode 310*a*, 310*b* and 310*c* and the plurality of the second bus electrode 320*a*, 320*b* and 320*c*, the gap between the first firing electrode 340 and the second firing electrode 350 is small so that discharges are initiated by small firing voltage. When discharges are initiated by the first firing electrode 340 and the second firing electrode 350, discharges are diffused to the whole dischrge cell by the first bus electrode 310*a*, 310*b* and 310*c* and the second bus electrode 320*a*, 320*b* and 320*c*. Accordingly, the first firing electrode 340 and the second firing electrode 350 play a role to lower the firing voltage. The plurality of the first bus electrode 310*a*, 310*b* and 310*c* and the plurality of the second bus electrode 320*a*, 320*b* and 320*c* improve the discharge efficiency. The discharge gap of the second embodiment of the present invention ranges from 120 μm to 300 μm.

When the first firing electrode 340 and the second firing electrode 350 are formed on the barrier rib, the decrease in the light transmitting rate is minimized and the firing voltage is lowered. The first protrusion electrode 345 and the second protrusion electrode 355 support the first firing electrode 340 and the second firing electrode 350 to perform discharges well.

A Third Embodiment

Figure 4:
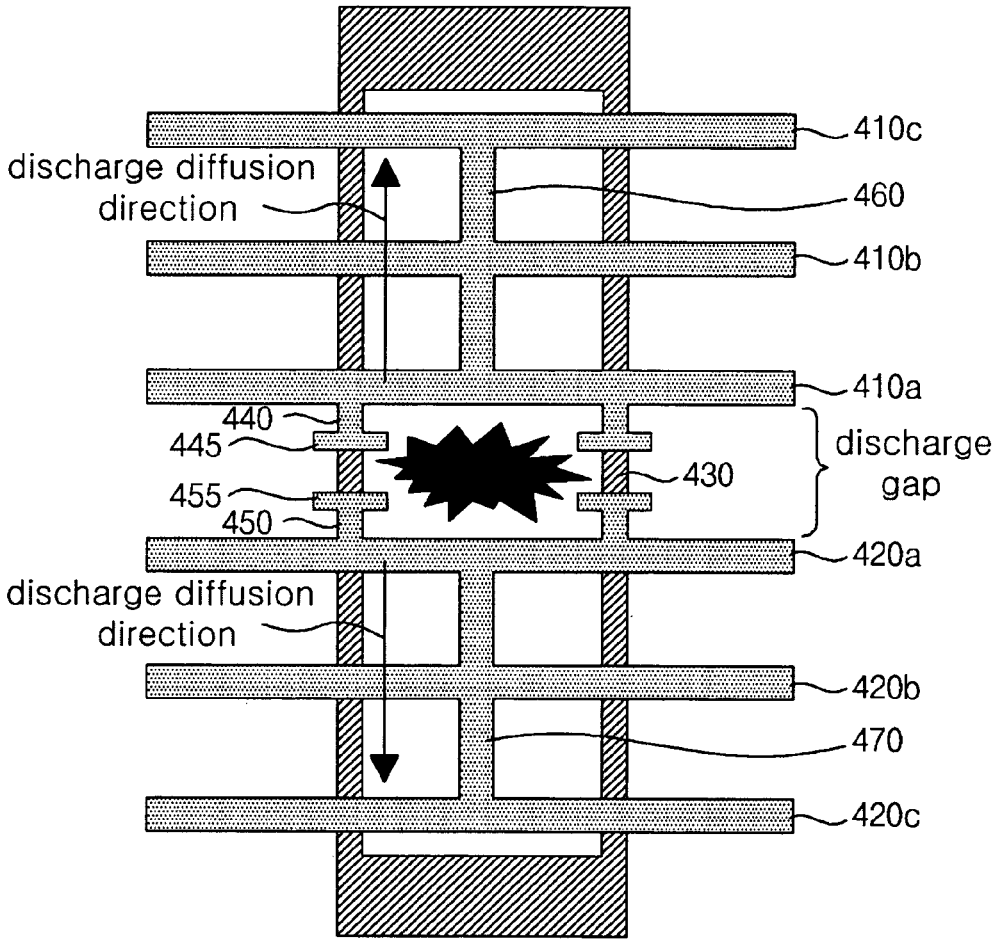
FIG. 4 is a plan view illustrating a plasma display panel according to a third embodiment of the present invention.

As shown in FIG. 4, a plasma display panel according to the third embodiment of the present invention comprises a first bus electrode 410*a*, 410*b* and 410*c*, a second bus electrode 420*a*, 420*b* and 420*c*, a barrier rib 430, a first firing electrode 440, a second firing electrode 450, a first connection electrode 460 and a second connection electrode 470.

A plurality of the first bus electrodes 410*a*, 410*b* and 410*c* are disposed in parallel with each other. The plurality of the first bus electrodes 410*a*, 410*b* and 410*c* perform the scan electrode function.

A plurality of the second bus electrodes 420*a*, 420*b* and 420*c* are disposed on the opposite side of the plurality of the first bus electrodes 410*a*, 410*b* and 410*c* in parallel with each other. The plurality of the second bus electrodes 420*a*, 420*b* and 420*c* perform the ssustain electrode function. The first bus electrode 410*a* adjacent to the center of discharge cell among the plurality of the first bus electrodes 410*a*, 410*b* and 410*c* and the second bus electrode 420*a* adjacent to the center of discharge cell among the plurality of the second bus electrodes 420*a*, 420*b* and 420*c* form a discharge gap.

The barrier rib 430 forms a discharge cell.

The first firing electrode 440 is connected to the first bus electrode 410*a* adjacent to the center of discharge cell among the plurality of the first bus electrodes 410*a*, 410*b* and 410*c* to protrude in the direction of the center of the discharge cell. The first firing electrode 440 may be formed within a discharge cell. However, preferably, the first firing electrode 440 should be formed on the barrier rib to prevent the decrease in the light transmitting rate. The-first firing electrode 440 comprise a first protrusion electrode 445 disposed in the perpendicular direction of the first firing electrode 440.

The second firing electrode 450 is connected to the second bus electrode 420*a* adjacent to the center of discharge cell among the plurality of the second bus electrodes 420*a*, 420*b* and 420*c* to protrude in the direction of the center of the discharge cell. The second firing electrode 450 may be formed within a discharge cell. However, preferably, the second firing electrode 450 should be formed on the barrier rib to prevent the decrease in the light transmitting rate. The second firing electrode 450 comprise a second protrusion electrode 455 disposed in the perpendicular direction of the first firing electrode 450.

The first connection electrode 460 connects the plurality of the first bus electrodes 410*a*, 410*b* and 410*c* in a discharge cell area.

The second connection electrode 470 connects the plurality of the second bus electrodes 420*a*, 420*b* and 420*c* in a discharge cell area.

The third embodiment of the present invention does not comprise the transparent electrode and just comprises the plurality of the first bus electrodes 410*a*, 410*b* and 410*c*, the plurality of the second bus electrodes 420*a*, 420*b* and 420*c*, the first firing electrode 440 and the second firing electrode 450. Accordingly, the second embodiment of the present invention is able to decrease the manufacturing cost of plasma display panel. Different with the first embodiment of the present invention, the second embodiment of the present invention comprises a plurality of first bus electrodes and a plurality of second bus electrodes. Thus, the diffusion of discharges is easier than the first embodiment.

If discharges are performed with only the first bus electrode 410*a*, 410*b* and 410*c* and the second bus electrode 420*a*, 420*b* and 420*c*, a discharge gap increases to be greater than the conventional gap so that the discharge efficiency increases. However, as a result in, the firing voltage increases to much. In other words, if the distance between electrodes increases, the capacitance between electrodes decreases. When the capacitance decreases, the reactive power decreases so that the discharge efficiency increases. However, when the distance between electrodes increases, the firing voltage increases as it is difficult to perform discharges. Thus, when discharges are performed with the first firing electrode 440 and the second firing electrode 450, together with the plurality of the first bus electrode 410*a*, 410*b* and 410*c* and the plurality of the second bus electrode 420*a*, 420*b* and 420*c*, the gap between the first firing electrode 440 and the second firing electrode 450 is small so that discharges are initiated by small firing voltage. When discharges are initiated by the first firing electrode 440 and the second firing electrode 450, discharges are diffused to the whole dischrge cell by the first bus electrode 410*a*, 410*b*, 410*c* and the second bus electrode 420*a*, 420*b* and 420*c*. Accordingly, the first firing electrode 440 and the second firing electrode 450 play a role to lower the firing voltage. The plurality of the first bus electrode 410*a*, 410*b* and 410*c* and the plurality of the second bus electrode 420*a*, 420*b* and 420*c* improve the discharge efficiency. The discharge gap of the third embodiment of the present invention ranges from 120 μm to 300 μm.

When the first firing electrode 440 and the second firing electrode 450 are formed on the barrier rib, the decrease in the light transmitting rate is minimized and the firing voltage decreases. The first protrusion electrode 445 and the second protrusion electrode 455 support the first firing electrode 440 and the second firing electrode 450 to perform discharges well.

The invention being thus described may be varied in many ways. Such variations are not to be regarded as a departure from the spirit and scope of the invention, and all such modifications as would be obvious to one skilled in the art are intended to be comprised within the scope of the following claims.

What is claimed is:

1. A plasma display panel comprising:

a first bus electrode and a second bus electrode forming a discharge gap;

a plurality of barrier ribs forming a plurality of discharge cells;

a plurality of first firing electrodes protruded from the first bus electrode to the second bus electrode, wherein each first firing electrode comprises a first protrusion electrode perpendicularly connected to the first firing electrode, and wherein the first protrusion electrodes are separated from each other; and a plurality of second firing electrodes protruded from the second bus electrode to the first bus electrode, wherein the first firing electrodes and second firing electrodes are directly over the barrier ribs, and wherein discharges are initiated between the first firing electrodes and the second firing electrodes.

2. The plasma display panel of claim 1, wherein each second firing electrode comprises a second protrusion electrode perpendicularly connected to the second firing electrode, and wherein the second protrusion electrodes are separated from each other.

3. A plasma display panel comprising:

a first bus electrode comprising a plurality of bus electrodes;

a second bus electrode comprising a plurality of bus electrodes and formed on the opposite side of the first bus electrode;

a plurality of barrier ribs forming a plurality of discharge cells;

a plurality of first firing electrodes connected with a bus electrode adjacent to the center of the discharge cells among the bus electrodes of the first bus electrode, and protruded to the second bus electrode, wherein each first firing electrode comprises a first protrusion electrode perpendicularly connected to the first firing electrode, and wherein the first protrusion electrodes are separated from each other; and a plurality of second firing electrodes connected with a bus electrode adjacent to the center of the discharge cell among the bus electrodes of the second bus electrode, and protruded to the first bus electrode, wherein the first firing electrodes and the second firing electrodes are directly over the barrier ribs, and wherein discharges are initiated between the first firing electrodes and the second firing electrodes.

4. The plasma display panel of claim 3, wherein each second firing electrode comprises a second protrusion electrode perpendicularly connected with the second firing electrode, and wherein the second protrusion electrodes are separated from each other.

5. The plasma display panel of claim 3, wherein the bus electrodes adjacent to the center of the discharge cells are apart from each other at a distance ranges from 120 μm to 300 μm.

6. A plasma display panel comprising:

a first bus electrode comprising a plurality of bus electrodes;

a second bus electrode comprising a plurality of bus electrodes and formed on the opposite side of the first bus electrode;

a plurality of barrier ribs forming a plurality of discharge cells;

a plurality of first firing electrodes connected with a bus electrode adjacent to the center of the discharge cells among the bus electrodes of the first bus electrode and protruded to the second bus electrode, wherein each first firing electrode comprises a first protrusion electrode perpendicularly connected to the first firing electrode, and wherein the first protrusion electrodes are separated from each other;

a plurality of second firing electrodes connected with-a bus electrode adjacent to the center of the discharge cell among the bus electrodes of the second bus electrode and protruded to the first bus electrode;

a first connection electrode connecting the bus electrodes of the first bus electrode in the discharge cell area; and a second connection electrode connecting the bus electrodes of the second bus electrode in the discharge cell area, wherein the first firing electrodes and the second firing electrodes are directly over the barrier ribs, and wherein discharges are initiated between the first firing electrodes and the second firing electrodes.

7. The plasma display panel of claim 6, wherein each second firing electrode comprises a second protrusion electrode perpendicularly connected with the second firing electrode, and wherein the second protrusion electrodes are separated from each other.

8. The plasma display panel of claim 6, wherein the bus electrode adjacent to the center of the discharge cells among the bus electrodes of the first bus electrode is separated from the bus electrode adjacent to the center of the discharge cell among the bus electrodes of the second bus electrode at a distance from 120 μm to 300 μm.

* * * * *